United States Patent [19]

Pentney

[11] 4,097,990

[45] Jul. 4, 1978

[54] PLASTIC DOUBLE EDGE RAZOR

[75] Inventor: Harry Pentney, Reading, England

[73] Assignee: The Gillette Company, Boston, Mass.

[21] Appl. No.: 763,030

[22] Filed: Jan. 27, 1977

[30] Foreign Application Priority Data

Feb. 5, 1976 [GB] United Kingdom ..... 4636/76

[51] Int. Cl.[2] ..... B26B 21/32

[52] U.S. Cl. ..... 30/57; 30/59; 30/66

[58] Field of Search ..... 30/47, 57, 58, 59, 66, 30/75, 84, 332, 337

[56] References Cited

U.S. PATENT DOCUMENTS

| | | | |
|---|---|---|---|
| 1,550,178 | 8/1925 | Logan | 30/84 X |
| 2,015,901 | 10/1935 | Lambert | 30/66 |
| 2,098,862 | 11/1937 | Ebert | 30/66 |
| 2,141,339 | 12/1938 | Bauerle | 30/84 X |
| 2,347,596 | 4/1944 | DeSwart | 30/47 |
| 2,612,685 | 10/1952 | Tully | 30/66 X |
| 3,934,338 | 1/1976 | Braginetz | 30/47 |
| 3,972,115 | 8/1976 | Ross | 30/59 |
| 4,037,321 | 7/1977 | Iten | 30/47 |

FOREIGN PATENT DOCUMENTS

| | | | |
|---|---|---|---|
| 613,247 | 11/1948 | United Kingdom | 30/84 |

*Primary Examiner*—Gary L. Smith
*Attorney, Agent, or Firm*—Richard A. Wise; Oistein J. Bratlie; Scott R. Foster

[57] ABSTRACT

A safety razor including a platform member and a cap member releasably interengageable to clamp a razor blade therebetween, the cap member having on its undersurface projection means which extend through the platform member and are adapted to be releasably engaged to clamp the said members together. The projection means have a substantial longitudinal extent to provide for distribution of the clamping forces.

2 Claims, 14 Drawing Figures

PLASTIC DOUBLE EDGE RAZOR

This invention relates to safety razors of the type comprising a guard platform member and a cap member which are releasably interengageable to position a thin flexible razor blade therebetween.

In the well known and widely used three-piece razor, the cap member has a central threaded stud which passes through the blade and guard platform member and is received in a threaded hole at one end of a separate handle, to clamp the members securely together with the blade firmly sandwiched between them. High stress concentrations arise in the region of the screw threaded parts, and this has the effect of limiting the choice of materials in which the components of the razor may be manufactured.

The present invention provides a razor in which this disadvantage is removed. More specifically, the invention provides a safety razor comprising a guard platform member and a cap member releasably interengageable to clamp a thin flexible razor blade therebetween, wherein the cap member is provided on its undersurface with projection means which extend through the guard platform member and are releasably engageable to clamp the said members together, and the said projection means have a substantial longigudinal extent to provide for distribution of the clamping forces. This construction makes possible the use of plastics materials in place of the metals traditionally employed, and a razor in accordance with the invention can be of all molded plastics construction.

The invention also includes a razor of relatively simple construction which offers the user more convenience of use than the traditional three-piece razor, in that the handle may remain coupled to the guard platform member and slidable relative thereto to effect engagement and release of the cap member. In the particular embodiments described below, the cap member has one or more projections depending from its lower surface which passes (or pass) through the guard platform member, to which the handle is attached for sliding movement in the longitudinal direction between a "release" position in which the projection(s) can pass upwardly through the guard platform member, and an operative locking position in which the projection(s) is (or are) engaged by the handle to clamp the parts in their operative positions.

The cap member may be completely separable from the guard platform member to expose the blade, or may be pivotally connected to the platform member so as to be movable between its operative clamping position and an open position, about a transverse axis.

Some presently preferred razors in accordance with the invention are described below, by way of example, with reference to the accompanying drawings, in which.

The razor illustrated in FIGS. 1 to 8 consists of three components, conveniently all of injection molded synthetic plastics material, a cap member 1, a guard platform member 2 and a handle 3, and is for use with a standard, double edged, thin, flexible razor blade 4.

Figure 1:
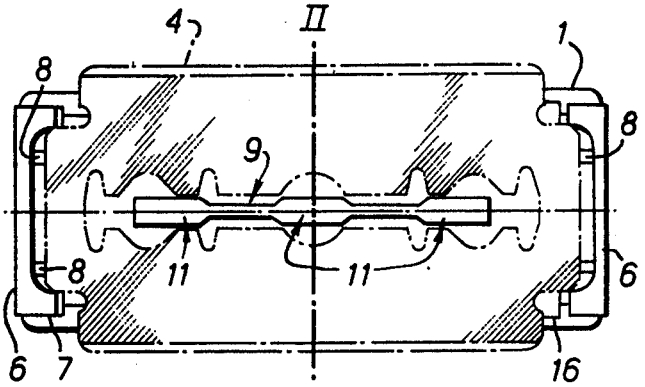
FIGS. 1 and 2 are a bottom plan and section of the cap member of a razor.
Figure 2:
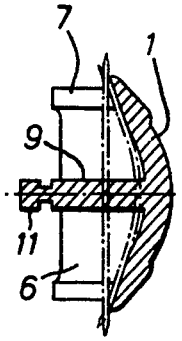
Figure 3:
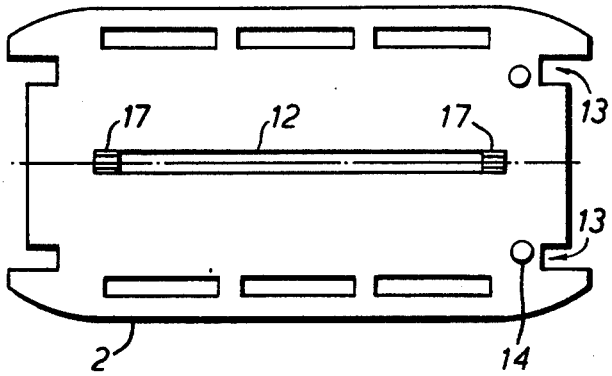
FIGS. 3 and 4 are a top plan and end view of the guard platform member of the same razor.
Figure 4:
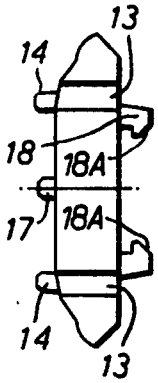
Figure 5:
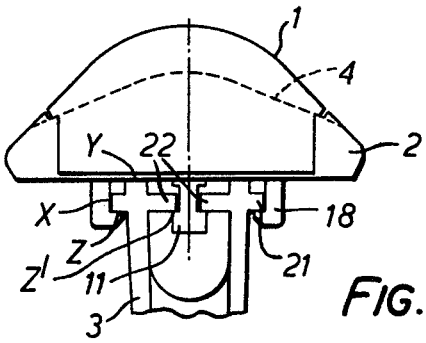
FIG. 5 is an end view of the razor.

The cap 1 has a concave inner surface with depending end walls 6 having short, longitudinally directed return portions 7 and small pips 8 to assist in locating a blade 4 longitudinally. The cap also has a depending elongate rib 9, the free edge of which is formed with local thickenings or lateral projections 11. The rib locates in the central slot of the blade 4 as seen in FIG. 1.

The guard platform member 2 has a central slot 12 to receive the rib 9 and is recessed at each end at 13 to accommodate the end walls 6 and return portions 7 of the cap. It has upstanding pips 14 to locate in corresponding recesses 16 in the cap and square bosses 17 to locate in the ends of the razor blade central slot.

Figure 6:
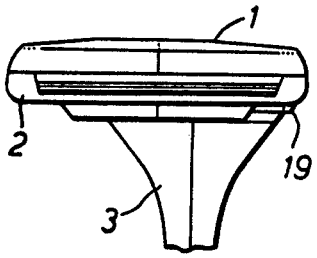
FIGS. 6 and 7 are side views of the same razor with the handle in its release and locking positions respectively.
Figure 7:
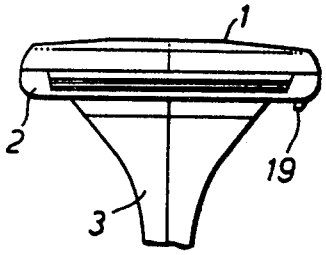

On its underside, the member 2 has a pair of L-section rails 18 for cooperation with the handle member 3 and two end stops, one of which is shown at 19 in FIGS. 6 and 7.

The handle 3 has a bifurcated upper end portion, the parallel limbs of which each have two continuous outer flanges 21 which slide on the rails 18 at 'X' and interrupted inner flanges 22 which cooperate with the lateral projections 11 of the cap rib 9.

For convenience of assembly, the lower, inner edges of the rails 18 are chamfered at 18A, so that the parts can be snap-fitted together by pressing the flanges 21 of the handle against the chamfers 18A, the limbs of the handle being deflected towards each other and then recovering resiliently as the flanges 21 pass the edges of the rails 18.

Figure 8:
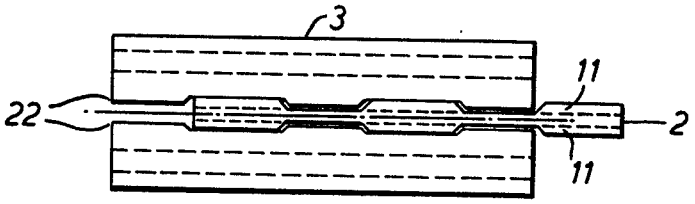
FIG. 8 is a section view of the razor in FIG. 6.

When the handle is in the release position shown in FIG. 6, the projections 11 register with the interruptions in the flanges 22 shown in FIG. 8 whereas in the locked position of FIG. 7, the flanges 22 engage over the projections 11 to hold the cap clamped down over the member 2. The upper ends of the handle abut the underside of the member 2 at 'Y' and lateral guidance is provided at the abutting surfaces 'Z'.

In use, a blade 4 is loaded on to the cap member 1 and located by the pips 8 and rib 9. The cap and blade are then offered up to the guard platform member and the rib 9 passes through the slot 12, the lateral projections 11 passing through the flanges 22. Some manual pressure is required to flex the blade, and when the cap is fully home, the handle 3 is moved (from right to left as viewed in FIG. 6) into its locked position, and the razor is ready for use.

The blade may be positively clamped between the members 1 and 2, with some resilient deflection of the razor components, or if slight clearance is allowed, may be held in flexed condition without positive clamping, its own resilience holding it in arched condition for shaving. This is controlled by selection of the dimensions of the members 1 and 2 and the spacing of abutting surfaces Y and Z. Shaving forces tending to tilt the members 1 and 2 about a longitudinal axis are resisted by reactions at surfaces X and Y.

Release of the cap to permit removal of the blade is, of course, effected by returning the handle to its release position of FIG. 6.

Figure 9:
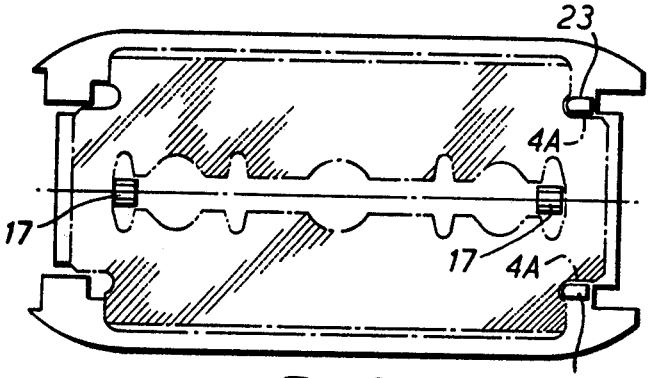
FIGS. 9 and 10 are a top plan and end view of the guard platform member of a second razor.
Figure 10:
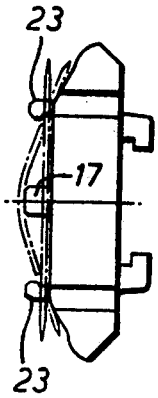
Figure 11:
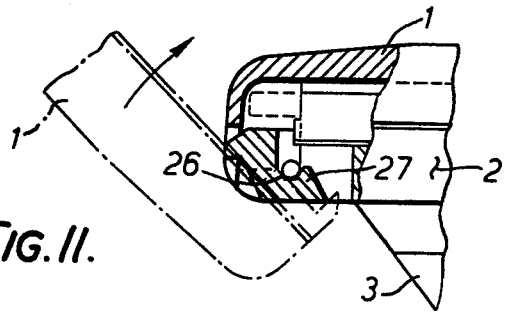
FIG. 11 is a diagrammatic partial side view of the second razor.

The second form of razor illustrated in FIGS. 9 to 11 is generally similar to the first, but is distinguished by the guard platform member 2 being adapted for preliminary location and frictional retention of the blade 4 and by the cap member being pivotally connected to the guard platform member for movement between its release and locking positions.

The guard platform member 2 has at one end a pair of upstanding blade stops 23 of undercut form (as seen in the end view of FIG. 10), so that the blade must be flexed to permit the shoulders 4A to pass between the upper ends of the stops 23, the blade then returning resiliently to its normal flat state adjacent the feet of the posts 23. The blade is located laterally and longitudinally by the square bosses 17.

As illustrated in FIG. 11 the cap member 1 has an integral transverse pivot pin 26 located in bearing portions 27 formed in the member 2, so that the cap can pivot about a transverse axis, parallel with the plane of the blade 4. The cap is swung clear of the guard platform member to permit removal of a blade and insertion of a fresh one, and is then swung over the member 2, so that its rib passes through the blade and guard platform member and can then be locked by movement of the handle 3, as in the first embodiment. Removal of a blade is facilitated by the provision of finger recesses at the ends of the guard platform member.

Figure 12:
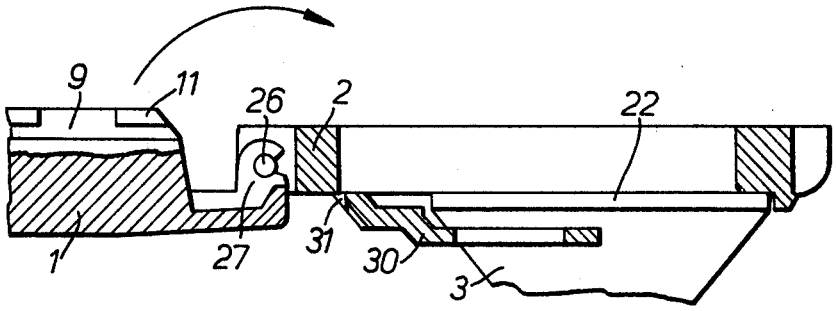
FIGS. 12, 13 and 14 are somewhat diagrammatic sectional elevations of a third form of razor.
Figure 13:
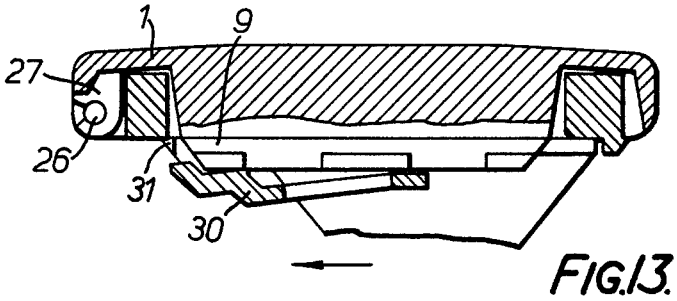
Figure 14:
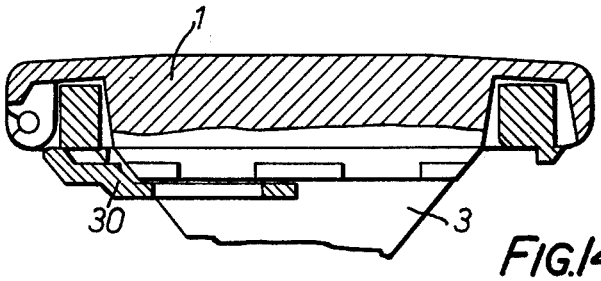

A further modified embodiment is illustrated in FIGS. 12, 13 and 14. This embodiment is generally similar to that of FIGS. 9 and 10, but incorporates a modified pivotal connection and an interlock to prevent the handle from being moved into its locking position, except when the cap member is in its operative, clamping position.

In this embodiment the pivotal connection is provided by an integral transverse pivot pin 26 and bearing portions 27 formed in the cap member 2, as before, but the latter are formed with re-entrant recesses for snap-fitting engagement over the pivot pin 26 which permit the cap member to be disengaged from the pin 26 by excess movement of the cap in the opening direction, i.e. anticlockwise movement of the cap beyond the fully open position shown in FIG. 12. This protects the part against damage by such excess movement.

The above mentioned interlock is provided forming the handle 3 with an integral cantilever spring 30 which lies in the path of the rib 9. In the fully open position of the parts shown in FIG. 12, the left hand end of the spring abuts a stop 31 formed on the undersurface of the member 2 to prevent movement of the handle to its locking position relative to the guard platform member 2. When the cap is swung over to its closed position, as shown in FIG. 13, the spring is deflected, so as to clear the stop 31, thus permitting movement of the handle to the locking position shown in FIG. 14.

The outer surface of the stop 31 is formed as a ramp to permit return of the handle to the release position without hindrance.

This interlock serves to ensure proper closing of the cap member before the user can move the handle into its locking position.

Such an interlock can, of course, also be provided on a razor in accordance with FIGS. 1 to 8.

In each of the above described embodiments, it will be seen that blade clamping forces are distributed longitudinally of the razor. While a continuous rib 9 is preferably employed, this could be replaced by separate pin-like projections to permit the razor to be used with blades of the type having three holes rather than a central slot.

By virtue of the distribution of clamping forces, the razors lend themselves well to manufacture in plastics components or if desired to part plastics part metal construction. For example the cap could be of metal and the other two components of plastics moldings.

Additionally, the razors offer a higher degree of convenience to users than traditional three-piece razors by virtue of their quick release and locking operation, compared with the somewhat inconvenient screw threaded connection of conventional razors. There is also some advantage in reducing the number of separate components. The second and third embodiments are particularly convenient in this respect since the three major components can remain coupled together throughout their working life if desired. On the other hand, the parts can be sprung apart at will to permit occasional thorough cleaning.

Having thus described my invention, what I claim as new and desire to secure by Letters Patent of the United States is:

1. A safety razor comprising a guard platform member, a cap member adapted to overlie said guard platform member to clamp a razor blade therebetween, projection means extending from an undersurface of said cap member, said guard platform member having opening means therethrough, said projection means being adapted to extend through said opening means in said guard platform member, said projection means having a longitudinal extent such as to provide for distribution of clamping forces, a handle adapted for sliding movement on said guard platform member between positions of engagement with said projection means to clamp said guard platform member and said cap member together and disengagement from said projection means, and interlock means acting between said handle and said guard platform member to prevent movement of said handle from its disengaged position to its engaged position relative to said projection means except when said cap member is in its clamping position relative to said guard platform member.

2. A safety razor according to claim 1 wherein the handle has a resilient portion for engagement with a stop fast with the guard platform member, the resilient portion being disposed in the path of the projection means so as to be displaced thereby, clear of the stop, when the cap member moves into its closed position.

* * * * *